US005394572A

United States Patent [19]

Humphreys

[11] Patent Number: 5,394,572

[45] Date of Patent: Mar. 7, 1995

[54] SELF ADJUST TUB DRAIN STOP

[75] Inventor: James W. Humphreys, Pentwater, Mich.

[73] Assignee: Lakeshore Automatic Products, Inc., Grand Haven, Mich.

[21] Appl. No.: 186,658

[22] Filed: Jan. 25, 1994

[51] Int. Cl.[6] ..... E03C 1/232

[52] U.S. Cl. ..... 4/683; 4/693; 74/586; 403/105

[58] Field of Search ..... 4/680, 682, 683, 688, 4/693; 74/586; 403/105, 368

[56] References Cited

U.S. PATENT DOCUMENTS

| | | | |
|---|---|---|---|
| 3,125,764 | 3/1964 | Young | 4/692 |
| 3,156,418 | 11/1964 | Jablonski et al. | 403/368 X |
| 3,366,980 | 2/1968 | Petursson et al. | 4/295 |
| 3,392,409 | 7/1968 | Politz | 4/683 |
| 3,428,295 | 2/1969 | Downey et al. | 251/263 |
| 3,468,512 | 9/1969 | Politz | 251/74 |
| 3,471,873 | 10/1969 | Politz | 4/683 |
| 3,494,639 | 2/1970 | Smith | 403/368 X |
| 3,995,333 | 12/1976 | Stephens | 4/286 |
| 4,007,500 | 2/1977 | Thompson et al. | 4/295 |
| 4,068,750 | 1/1978 | Gatewood | 403/368 X |
| 4,103,372 | 8/1978 | Cuschera | 4/286 |
| 4,276,662 | 7/1981 | Young | 4/295 |
| 4,339,832 | 7/1982 | Cuschera | 4/286 X |
| 4,352,213 | 10/1982 | Watts | 4/683 |
| 4,412,361 | 11/1983 | Cuschera | 4/286 |
| 4,892,003 | 1/1990 | Quinlan | 403/105 X |
| 4,910,807 | 3/1990 | Willis | 4/683 |

FOREIGN PATENT DOCUMENTS

| | | | |
|---|---|---|---|
| 1267151 | 6/1961 | France | 403/368 |
| 0200322 | 3/1939 | Switzerland . | |

*Primary Examiner*—Robert M. Fetsuga
*Attorney, Agent, or Firm*—Price, Heneveld, Cooper, DeWitt & Litton

[57] ABSTRACT

A bath drain outlet control having an actuator, a plunger valve for engaging a valve seat of a bath drain outlet, a linkage between the actuator and the plunger valve, including a one-way slip clutch enabling the linkage to be contractably adjustable, and a slip clutch deactuator movable into operative relationship with the one-way slip clutch to temporarily allow expansion adjustment of said linkage. The one-way slip clutch has an elongated rod forming part of the linkage, a retaining ring having a plurality of sloped spring fingers around the rod, having an inherent bias toward the rod, and having rod engaging ends normally allowing rod movement in a linkage-contracting direction therethrough but preventing reverse rod movement therethrough in a linkage-extending direction. A compressed O-ring engages the sloped spring fingers to add bias supplementing the inherent finger bias toward said rod and equalizing the bias of the spring fingers against the rod.

7 Claims, 2 Drawing Sheets

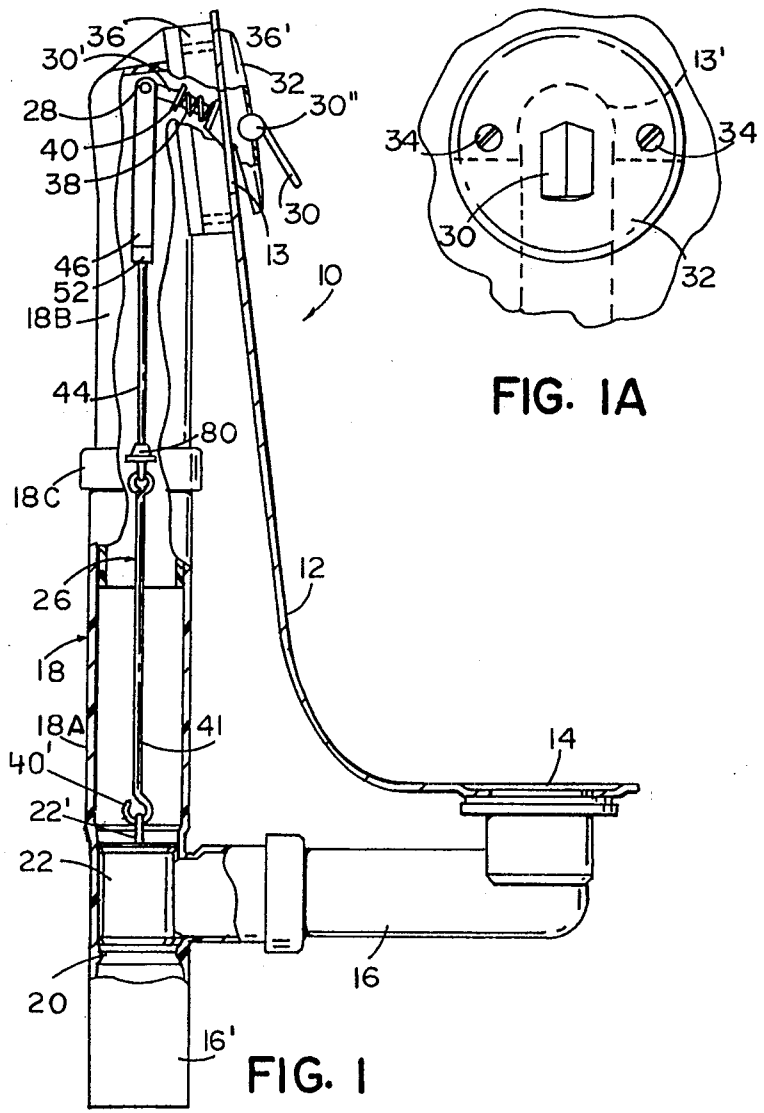
FIG. 1A
FIG. 1
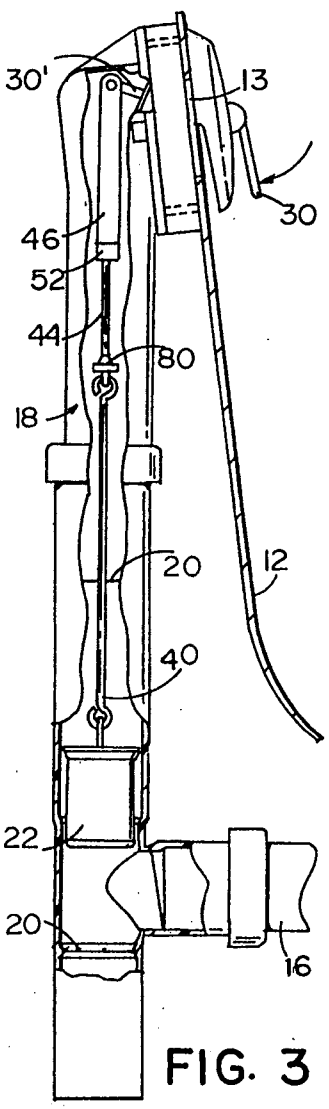
FIG. 3
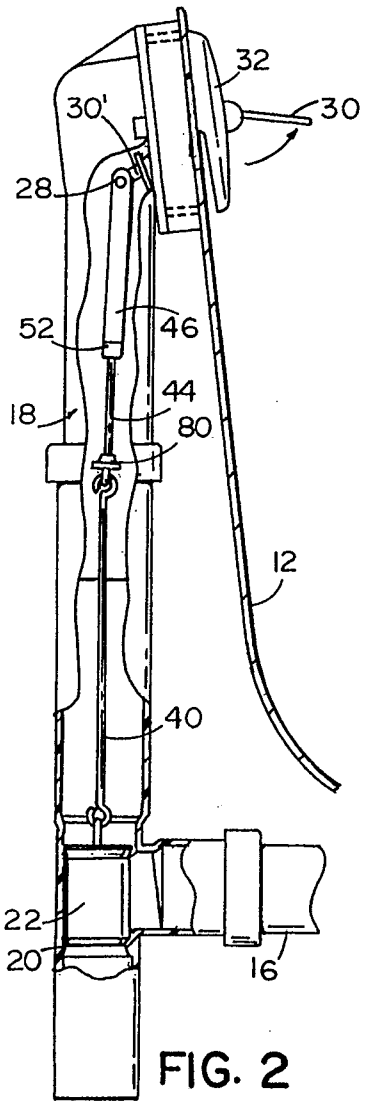
FIG. 2

SELF ADJUST TUB DRAIN STOP

BACKGROUND OF THE INVENTION

This invention relates to bath waste outlet control mechanisms, also known as tub drain stop mechanisms, and more particularly to an adjustable-in-place, bath outlet control valve mechanism.

Bathtub waste control valves known for decades typically have a length adjustment device to enable the valve element, usually a cylindrical stop, to be adjustably positioned at the time of installation so that it will be in proper sealing relationship to the drain outlet when actuated. The adjustment has usually taken the form of a threaded rod and nut combination forming part of the linkage between the actuator and the valve. The installing plumber places the mechanism inside the conduit provided, attaches the actuator, shifts the actuator to see if the valve properly closes and, if not, as usual, removes the mechanism, adjusts the nut on the rod, replaces it, tests it, and ultimately repeats this procedure enough times to get the desired adjustment. This can be a tedious, time consuming task which can result in the plumber becoming frustrated and willing to leave the valve in an undesirable position, or can result in a costly installation bill, among other things. However, this mechanism is still employed, particularly in the low end line of bathtub valve mechanisms, because it is relatively inexpensive to manufacture.

A significantly more costly mechanism set forth in U.S. Pat. No. 4,910,806 was later developed to enable the plumber to adjust the linkage with the first actuation of the actuator and valve. A special ratchet rod and sleeve enable the linkage to be contractibly adjustable, i.e., shortened, by movement of the actuator when the valve is seated. Although this device saves considerable time and energy for the installer, it still has disadvantages. Firstly, it is relatively costly to manufacture and thus is used only on the high end line, i.e., higher quality line, of plumbing products. Secondly, it is rather difficult to insert into the conduit. Thirdly, if it gets adjusted too short, either before or after installation, it cannot be lengthened without great difficulty. Specifically, the rod mechanism must be removed from the drain, the spring clip removed, the rod withdrawn, the spring clip reinserted, and the mechanism reinstalled.

SUMMARY OF THE INVENTION

An object of this invention is to provide a tub drain actuator and valve mechanism which is fully effective, adjustable-in-place, and sufficiently low in manufacturing cost to enable its use in low end plumbing as well as high end plumbing. Another advantage is to provide such a mechanism which can be readily installed even as a retrofit unit on existing tubs, and properly adjusted with the first actuation of the actuator and valve. It is a further object of this invention to provide such a mechanism which can be readily contractibly adjusted and, if contracted too much, can be expansion adjusted a controlled amount utilizing a simple, inexpensive release device mounted on the linkage rod.

These and several other objects, advantages and features of the invention will become apparent upon studying the following specification in conjunction with the drawings.

The novel device includes a linkage between the actuator link and the valve, embodying a one-way slip clutch enabling the linkage to be contractibly adjustable, and a slip clutch deactuator or release device movable into operative relationship with the one-way slip clutch to temporarily allow expansion adjustment of the linkage. The one-way slip clutch is around an elongated rod of the linkage, has a retaining ring which has a plurality of sloped spring fingers around the rod, engaging the rod, and having an inherent bias toward the rod, so that the rod-engaging ends of the spring fingers allow sliding movement of the rod in one direction, but bite into it to normally prevent reverse movement. These spring fingers are combined with an O-ring in pressing relationship with the spring fingers, on the outer surfaces of the fingers, to effect further bias to the spring fingers toward the rod and, surprisingly, to equalize the bias of the plurality of fingers against the rod. The clutch deactuator or release device comprises an annular, frustoconical member which has a tapered surface engageable with the inside of the sloping spring fingers such that pressing of this deactuator against the fingers acts against the inherent bias of the fingers and against the compression bias of the O-ring, to cause sufficient momentary release of the fingers from the rod to enable the rod to be moved in the reverse direction for lengthening adjustment of the actuator linkage.

These and other objects, advantages and features of the invention will become apparent upon studying the following specification in conjunction with the drawings.

BRIEF DESCRIPTION OF THE DRAWINGS

FIG. 1 is a side elevational, partially sectional view of a bath waste outlet control assembly in place in a tub and drain apparatus, in the condition as originally installed where the linkage is greater in length than needed for proper sealing;

FIG. 1A is a fragmentary, front elevational view of the control actuator for the apparatus in FIG. 1;

FIG. 2 is a side elevational, partially sectional view of the mechanism in FIG. 1, showing the actuator in its elevated actuated position during the first actuation of the mechanism, to adjust the linkage length to the appropriate amount for effective sealing of the valve on the valve seat;

FIG. 3 is a side elevational, partially sectional view of the apparatus in FIGS. 1 and 2, showing the valve in the open condition after the first actuation thereof;

DESCRIPTION OF THE PREFERRED EMBODIMENT

Figure 9:
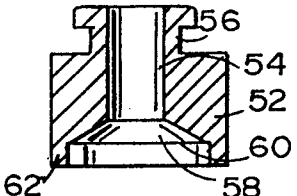
FIG. 9 is a side elevational sectional view of the retention body for the slip clutch apparatus, prior to being attached and deformed.
Figure 10:
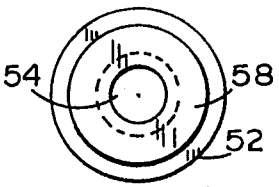
FIG. 10 is a bottom elevational view of the body in FIG. 9.

Referring now specifically to the drawings, the complete apparatus 10 there depicted is shown to include a fragmentary portion of a conventional bathtub 12 having a drain outlet 14 to the outlet waste conduit 16, 16'. Joining and in alignment with this drain conduit is a conventional, vertical, tubular housing 18 for the actuator linkage. This tubular housing has a juncture with and extends up from drain conduit 16 to form a valve seat 20 just downstream of the horizontal portion of drain conduit 16 at the top of the vertical portion of conduit 16'. Housing 18 is typically formed of a lower cylindrical portion 18*a* connected to an upper cylindrical portion 18*b* by a coupling 18*c*. Valve seat 20 is an annular tapered surface of conventional type, intended to cooperate with the bottom end of cylindrical plunger stop valve 22 which can be moved vertically in housing 18 to open (by being raised), or close Coy being, lowered), the valve seat, to control drainage from the bathtub. Connected to and extending upwardly from valve 22 is a linkage subassembly 26 pivotally mounted at its upper end pivot 28 to the extended end 30' of actuator lever 30. Lever 30 extends into the tub and is pivotally mounted intermediate its ends at 30'' to the mounting plate 32. This exterior mounting plate, usually circular in general configuration, is attached by a pair of mounting screws 34 to an interior backing plate 36 forming the upper part of housing 18 over an opening 13 in the tub 12.

Most of the components of drain conduit 16 and 16', housing 18, and backing plate 36, are preferably formed of polymeric materials, while the face plate 32 is typically of metal. Optionally, lever extension 39' can have a conventional compression coil spring 38 therearound, retained ;between a pair of washers 40 for applying a slight bias toward the lowered position of lever 30 (see FIG. 3).

Figure 5:
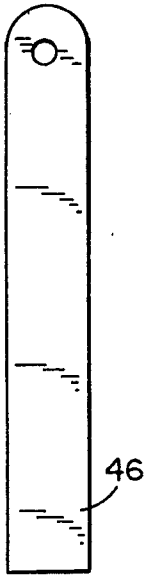
FIG. 5 is an elevational view of the clevis in FIG. 4, taken from a view ninety degrees rotated from FIG. 4.
Figure 6:
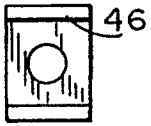
FIG. 6 is a top elevational view of the clevis in FIG. 5.

Linkage subassembly 26 is shown to include a first elongated links 41 having a loop 40' on its lower end loosely pivotally interengaged with a loop 22' on the top of valve 22, and having a loop on its upper end loosely interengaged with a loop on the lower end of adjustment rod 44 which is preferably cylindrical in configuration. Adjustment rod 44 extends up through and is connected to a U-shaped clevis 46 (FIGS. 4, 5 and 6) with a slip clutch arrangement to be described. Clevis 46 has a pivot pin 28 extending through both of its legs to pivotally connect it to towardly extended end 30' of lever 30 noted previously.

Figure 12:
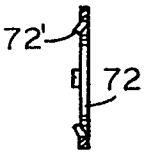
FIG. 12 is a side elevational view of the retaining ring in FIG. 11.
Figure 7:
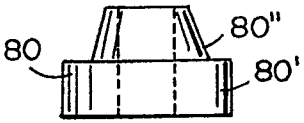
FIG. 7 is an enlarged elevational view of the slip clutch deactuator.
Figure 8:
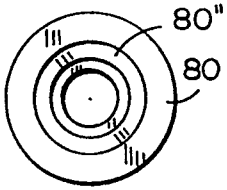
FIG. 8 is a top plan view of the deactuator in FIG. 7.
Figure 11:
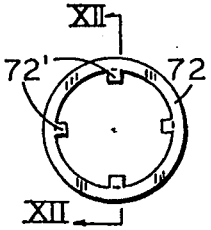
FIG. 11 is a plan view of the retaining ring portion of the slip clutch.
Figure 4:
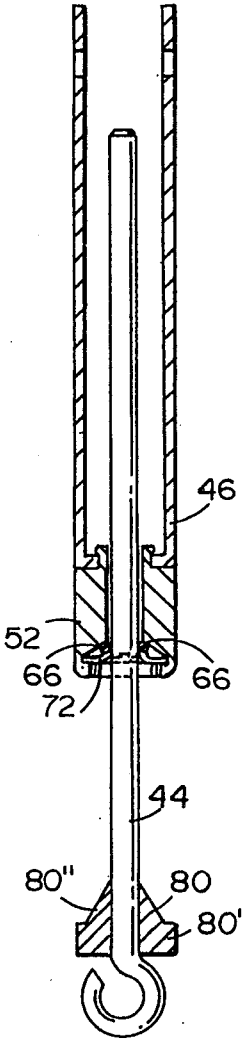
FIG. 4 is an enlarged, fragmentary, elevational view of a portion of the linkage of the mechanism in FIGS. 1–3, showing the slip clutch, clevis and slip clutch deactuator in cross section.

Attached to the bottom end of clevis 46, and specifically to the cross member thereof, is a slip clutch retention body 52 (FIGS. 2–4 and 9) which is shown to be generally cylindrical on its exterior, and formed to have an axial passage 54 therethrough (FIG. 9), with an upwardly projecting rim 56 around passage 54 to be peened over onto the cross leg of clevis 46 as depicted in FIG. 4, for securing the clevis and body 52 together. The lower end of body 52 includes an annular, frustoconical, upwardly-radially-inwardly tapered upper cavity portion 58 and a generally cylindrical cavity 60 therebelow, cavity 60 being surrounded by a peripheral annular rim 62 (FIG. 9) until assembled. During assembly, an O-ring 66 is placed within frustoconical cavity 58, and retaining ring 72 placed beneath the O-ring. Rim 62 is peened radially inwardly over the retaining ring to capture the retaining ring and O-ring in a compressed fashion causing the O-ring to be axially and radially compressed so as to bear against the adjacent plurality of upwardly, radially-inwardly extending, sloped spring fingers 72' (FIGS. 11 and 12). The tapered upper surface of the frustoconical cavity tends to compress the O-ring axially and radially against the outside surfaces of the sloping spring fingers 72'. These spring fingers are preferably at ninety degree intervals around the retaining ring. This plurality of four fingers, integral with the ring, are of conventional retaining ring construction, and have inherent resilience to be biased into tight engagement with the peripheral surface of adjustment rod 44. The angularly oriented spring fingers will allow the adjustment rod to move vertically up through the fingers in one direction for contraction adjustment of the linkage assembly, but will bite into the surface of the adjustment rod to resist force tending to lengthen, i.e., extend, the linkage by downward movement of the rod. Above the retaining ring, and specifically the spring fingers thereof, is the other biasing means shown in the form of the resilient, compressible O-ring, normally of rubber, which is compressed between the frustoconical surface thereabove and the fingers therebelow. The compressed O-ring 66 has been found to not only add further bias to the fingers radially inwardly into engagement with the peripheral cylindrical surface of rod 44, but surprisingly to also act as a balancing means to cause the stress on each of the plurality of fingers 72' to be basically equal. The function and useful life of the retaining ring was found to be significantly better and longer, respectively, when the O-ring was combined with the retaining ring in the assembly.

Also positioned on adjustment rod 44 beneath body 52 and retaining ring 72, and movable axially along the rod, is a slip clutch deactuator 80 which is shown to be a ring which includes an annular lower portion 80' and an upwardly protruding frustoconical upper portion 80'' which tapers radially-inwardly-upwardly. This deactuator has a central orifice through which rod 44 extends so that the deactuator can be readily manually moved up along rod 44 so as to be placed into engagement with the tapered inside surfaces of spring fingers 72' from beneath. By applying axial force of deactuator 80 against the spring fingers, against the inherent bias of the spring fingers and the compressive bias of O-ring 66, the spring fingers are caused to momentarily move radially outwardly and upwardly to momentarily release their compressive biting grip on adjustment rod 44, to allow the adjustment rod and body 52 to be shifted in the reverse direction through the slip clutch, i.e., to lengthen the linkage. This is particularly advantageous to alleviate the condition of the linkage of becoming overly foreshortened as during assembly, shipment, handling or installation.

The installation of this novel assembly into a new tub assembly, or to retrofit it into an existing tub assembly, is achieved by inserting valve 22 down through opening 13 and allowing it to slide down tubular housing 18, followed by linkage subassembly 26, until metal actuator: plate 32 is positioned to cover opening 13. Screws 34 are then threaded through plate 32 and into backing plate 36 so that the assembly appears as in FIG. 1, with linkage 26 still being too long. Then, with one lift of actuator 30, as shown in FIG. 2, the lower end of valve 22 will engage valve seat 20 such that further lifting of actuator 30 to its upper limit will cause the slip clutch subassembly to allow the upper end of adjustment rod 44 to move further upwardly through the slip clutch, until the actuator is at its uppermost position. The slip clutch, more specifically, allows rod 44 to slide through the spring fingers 72' and O-ring 66 to shorten the linkage. The unit is immediately ready for future operation. Subsequent lowering of actuator 30, as in FIG. 3, will cause the linkage to raise valve 22 off valve seat 20 and out of alignment with conduit 16, to open the drain, but not allow rod 44 to slip in the opposite, i.e., extending, direction.

If somehow valve 22 and its linkage were to become shortened too much during shipping, handling, assembly or the like, such that valve 22 does not adequately seal down against seat 20 when actuator 30 is raised, a lengthening adjustment can be readily made simply by shifting deactuator 80 axially up on rod 44 and pushing it up into forced engagement with the underside, i.e., inside surfaces, of spring fingers or teeth 72', counter to the bias of the fingers, thereby releasing bias of the fingers, then pulling rod 44 down through the slip clutch to lengthen the linkage to a condition longer than what would ultimately be necessary, inserting the assembly into housing 18, attaching screws 34 to mount the actuator plate, and then lifting actuator 30, as in FIG. 2, to get the proper length for the linkage. If the assembly is already mounted in the tub when the too-short condition is realized, the assembly is first removed by unscrewing mounting screws 34, pulling the assembly out of tubular housing 18, performing the adjustment just described above, and replacing the assembly in the housing.

The novel combination has been found to work very effectively, and moreover is relatively inexpensive to manufacture, as well as being easily assembled and disassembled as needed. Conceivably those skilled in this field will readily see additional advantages and features, as well as certain minor modifications to suit particular installations. Hence, the invention is not intended to be limited specifically to the preferred embodiment set forth above as exemplary of this invention, but only by the scope of the appended claims and the reasonably equivalent structures to those defined therein.

The embodiments of the invention in which an exclusive property or privilege is claimed are defined as follows:

1. A bath drain outlet control comprising:

an actuator, said actuator having a link;

a plunger valve for engaging a valve seat of the bath drain outlet;

a linkage between said actuator link and said plunger valve, said linkage having a one-way slip clutch enabling said linkage to be contractibly adjustable;

said one-way clutch comprising an elongated rod forming part of said linkage, a retaining ring having a plurality of sloped spring fingers around said rod, said spring fingers having inside surfaces toward said rod and outside surfaces away from said rod, and having an inherent bias toward said rod, said spring fingers having rod engaging ends normally allowing rod movement in a linkage-contracting direction therethrough but preventing reverse rod movement therethrough in a linkage-extending direction;

an O-ring and a retention surface holding said O-ring in firm engagement with said outside surfaces of said plurality of sloped spring fingers in a manner to add bias to said sloped spring fingers supplementing said inherent finger bias toward said rod and equalizing the bias of said spring fingers against said rod; and a slip clutch deactuator movable into operative relationship with said one-way slip clutch to temporarily allow expansion adjustment of said linkage.

2. The bath drain outlet control in claim 1 wherein said deactuator comprises an annular ring having a nose, said ring being slidable along said rod to place said nose into engagement with said inside surfaces of said sloped fingers to shift said fingers against their inherent bias sufficient to allow said reverse rod movement.

3. The bath drain outlet control in claim 1 wherein said deactuator comprises an annular frustoconical ring slidable along said rod into engagement with said inside surfaces of said sloped fingers to shift said fingers against their inherent bias and shift said O-ring against its bias to allow said reverse rod movement.

4. A bath drain outlet control comprising:

an actuator, said actuator having a link;

a plunger valve for engaging a valve seat of the bath drain outlet;

a linkage between said actuator link and said plunger valve, said linkage having a one-way slip clutch enabling said linkage to be contractibly adjustable;

said one-way slip clutch comprising an elongated rod forming part of said linkage, a retaining ring having a plurality of sloped spring fingers around said rod having inside surfaces toward said rod and outside surfaces away from said rod, and having an inherent bias toward said rod, said spring fingers having rod engaging ends normally allowing rod movement in a linkage-contracting direction therethrough but preventing reverse rod movement therethrough in a linkage-extending direction; and an O-ring and a retention surface holding said O-ring in firm engagement with said outside surfaces of said plurality of sloped spring fingers in a manner to add bias to said sloped spring fingers, supplementing said inherent fingers bias toward said rod and balancing the bias load on said spring fingers.

5. The bath drain outlet control in claim 4 including a deactuator for said one-way slip clutch, and wherein said deactuator comprises an annular ring having a nose, said ring being slidable along said rod to place said nose into engagement with said inside surfaces of said sloped fingers to shift said fingers against their inherent bias to allow said reverse rod movement.

6. The bath drain outlet control in claim 4 including a deactuator for said one-way slip clutch, and wherein said deactuator comprises an annular frustoconical ring movable along said rod into engagement with said inside surfaces of said sloped fingers to shift said fingers against their inherent bias and shift said O-ring against its bias to allow said reverse rod movement.

7. A bath drain outlet control comprising:

an actuator, said actuator having a link;

a plunger valve for engaging a valve seat of the bath drain outlet;

a linkage between said actuator link and said plunger valve, said linkage having a one-way slip clutch enabling said linkage to be contractibly adjustable;

said one-way slip clutch comprising an elongated rod forming part of said linkage, a retaining ring having a plurality of sloped spring fingers around said rod having inside surfaces toward said rod and outside surfaces away from said rod, and having an inherent bias toward said rod, said spring fingers having rod engaging ends normally allowing rod movement in a linkage-contracting direction therethrough but preventing reverse rod movement therethrough in a linkage-extending direction; and an additional biasing means in firm engagement with said outside surfaces of said plurality of sloped spring fingers for adding further bias to said sloped spring fingers, supplementing said inherent finger bias toward said rod.

* * * * *

UNITED STATES PATENT AND TRADEMARK OFFICE

CERTIFICATE OF CORRECTION

PATENT NO. : 5,394,572

DATED : March 7, 1995

INVENTOR(S) : James W. Humphreys

It is certified that error appears in the above-indentified patent and that said Letters Patent is hereby corrected as shown below:

Column 3, line 20;
"Coy being," should be -- (by being --;

Column 3, line 37;
"; between" should be -- between --;

Column 3, line 41;
"links" should be -- link --;

Column 3, line 50;
"towardly" should be -- inwardly --;

Column 4, line 59-60;
"actuator:" should be -- actuator --;

Column 5, line 53;
After "said one-way" insert -- slip --.

Signed and Sealed this

Twelfth Day of September, 1995

*Attest:*

*Attesting Officer*

Bruce Lehman

BRUCE LEHMAN

*Commissioner of Patents and Trademarks*